US010676839B2

(12) United States Patent
Katayama et al.

(10) Patent No.: US 10,676,839 B2
(45) Date of Patent: Jun. 9, 2020

(54) ELECTRODEPOSITION SYSTEM AND ELECTRODEPOSITION METHOD

(71) Applicants: Mazda Motor Corporation, Fuchucho (JP); Taikisha Ltd., Tokyo (JP)

(72) Inventors: Katsuo Katayama, Fuchucho (JP); Hiroyuki Nakagawa, Fuchucho (JP); Hiroaki Tsuji, Fuchucho (JP); Akira Kawanami, Fuchucho (JP); Shintarou Kouno, Fuchucho (JP); Shigetaka Tooka, Tokyo (JP); Shizuko Kurokawa, Tokyo (JP)

(73) Assignees: Mazda Motor Corporation, Hiroshima (JP); Taikisha Ltd., Tokyo (JP)

( * ) Notice: Subject to any disclaimer, the term of this patent is extended or adjusted under 35 U.S.C. 154(b) by 0 days.

(21) Appl. No.: 15/744,168

(22) PCT Filed: Jul. 13, 2016

(86) PCT No.: PCT/JP2016/070657
§ 371 (c)(1),
(2) Date: Jan. 12, 2018

(87) PCT Pub. No.: WO2017/010504
PCT Pub. Date: Jan. 19, 2017

(65) Prior Publication Data

US 2018/0202064 A1 Jul. 19, 2018

(30) Foreign Application Priority Data

Jul. 15, 2015 (JP) ..... 2015-141511

(51) Int. Cl.
*C25D 21/08* (2006.01)
*C25D 13/24* (2006.01)
(Continued)

(52) U.S. Cl.
CPC ..... *C25D 21/08* (2013.01); *C25D 13/12* (2013.01); *C25D 13/22* (2013.01); *C25D 13/24* (2013.01); *C25D 21/02* (2013.01)

(58) Field of Classification Search
CPC ... C25D 13/00–24; B08B 3/102; B08B 3/022; B60S 3/04
See application file for complete search history.

(56) References Cited

U.S. PATENT DOCUMENTS 6,090,253 A * 7/2000 Shima ..... C25D 13/22 204/500
2003/0155002 A1* 8/2003 Vazquez ..... B01D 17/005 134/108

FOREIGN PATENT DOCUMENTS

CN 101624720 A 1/2010
CN 103436940 A 12/2013
(Continued)

OTHER PUBLICATIONS

Awamura et al., Machine Translation, JP H06-101095 A (Year: 1994).*

(Continued)

*Primary Examiner* — Brian W Cohen
*Assistant Examiner* — Ho-Sung Chung
(74) *Attorney, Agent, or Firm* — The Webb Law Firm

(57) ABSTRACT

In an electrodeposition system, the final quality of a coating is prevented from being degraded due to a coating material-containing aqueous solution flowing out of a steel plate mating portion during a drying process, while derivative problems such as an increase in the size of the system, an increase in the initial costs and the running costs, and a decrease in reliability are avoided. A washing zone that is subsequent to an electrodeposition zone in which an object to be coated is immersed in a coating material solution for electrodeposition so that a coating is formed on a surface of (Continued)

the object to be coated is provided with: a hot water washing tank in which the coated object is washed by being immersed in high-temperature washing water in the tank; and a spray washer that sprays a steel plate mating portion of the coated-object with high-temperature washing water, subsequent to washing in the hot water washing tank.

5 Claims, 4 Drawing Sheets

(51) Int. Cl.

| | |
|---|---|
| ***C25D 13/12*** | (2006.01) |
| ***C25D 13/22*** | (2006.01) |
| ***C25D 21/02*** | (2006.01) |

(56) References Cited

FOREIGN PATENT DOCUMENTS

| | | | | |
|---|---|---|---|---|
| JP | 52155645 | A | | 12/1977 |
| JP | 4346696 | A | | 12/1992 |
| JP | 06101095 | A | * | 4/1994 |
| JP | 9241890 | A | | 9/1997 |
| JP | 9268397 | A | | 10/1997 |
| JP | 1180996 | A | | 3/1999 |
| JP | 11131291 | A | | 5/1999 |
| JP | 11131291 | A | * | 5/1999 |
| JP | 3154568 | B2 | | 4/2001 |
| JP | 3309699 | B2 | | 7/2002 |
| JP | 200812374 | A | | 1/2008 |
| JP | 2008189963 | A | * | 8/2008 |
| JP | 2009167496 | A | * | 7/2009 |
| JP | 2009249681 | A | | 10/2009 |
| JP | 2009293079 | A | | 12/2009 |

OTHER PUBLICATIONS

Sakamoto et al., Machine Translation, JP 2008-189963 A (Year: 2008).*

Arakawa et al., Machine Translation, JP H11-131291 A (Year: 1999).*

Ogura et al., Machine Translation, JP 2009-293079 A (Year: 2009).*

Ogura et al., Machine Translation, JP 2009-167496 A (Year: 2009).*

Awamura et al., human translation, JP H06-101095 A (Year: 1999).*

Second Office Action dated Jul. 11, 2019 issued in connection with corresponding Chinese Patent Application No. 201680041512.X and English-language translation thereof.

Second Office Action dated Aug. 6, 2019 issued in connection with corresponding Japanese Patent Application No. 2015-141511 and English-language translation thereof.

* cited by examiner

ELECTRODEPOSITION SYSTEM AND ELECTRODEPOSITION METHOD

CROSS-REFERENCE TO RELATED APPLICATIONS

This application is the United States national phase of International Application No. PCT/JP2016/070657 filed Jul. 13, 2016, and claims priority to Japanese Patent Application No. 2015-141511 filed Jul. 15, 2015, the disclosures of which are hereby incorporated in their entirety by reference.

TECHNICAL FIELD

The present invention relates to an electrodeposition system and an electrodeposition method.

More specifically, the present invention relates to an electrodeposition system that includes: an electrodeposition zone in which an object to be coated is immersed in a coating material solution for electrodeposition so that a coating is formed on the surface of the object to be coated; a washing zone in which the coated object having the coating formed on the surface thereof in the electrodeposition zone is washed using washing water; and a drying zone in which the coated object washed in the washing zone is heated so that the coating of the coated object is hardened and dried, and the present invention also relates to an electrodeposition method using the electrodeposition system.

BACKGROUND ART

An object to be coated using electrodeposition, such as the body of an automobile, often includes steel plate mating portions, such as a bag-shaped portion in a door included in the body of an automobile.

The steel plate mating portions are gaps between steel plates, the entrances of which are narrowed due to steel plates being brought into contact with each other when the object to be coated is processed, so that communication with the outside is limited.

When electrodeposition is performed, during an electrodeposition process in which the object to be coated is immersed in a coating material solution for electrodeposition, and a washing process in which the coated object that has undergone the electrodeposition process is washed using washing water, the coating material solution and washing water used in these processes enter into the steel plate mating portions.

The coating material solution and washing water that have entered into the steel plate mating portions are likely to remain in the steel plate mating portions in the form of a coating material-containing aqueous solution in which the coating material solution and washing water are mixed with each other, even after the washing process for the coated object is completed.

Therefore, during the drying process in which the coated object is heated so that the coating is hardened and dried, a coating material-containing aqueous solution remaining in the steel plate mating portions rapidly boils due to rapid heating, and flows out of the steel plate mating portions, and a coating material-containing aqueous solution that has flowed out adheres to a neighboring portion of the coating of the coated object.

Then, a coating material component contained in the coating material-containing aqueous solution adhering to the coating is dried during the drying process together with the coating, in the state of adhering to the coating.

Conventionally, there is a problem in which the final quality of the coating of a coated object is significantly degraded due to the above-described phenomenon (degradation in the final quality of a coating due to so-called "secondary sagging").

To address such a problem, Patent Document 1 below, for example, proposes an electrodeposition method in which, after a coated object that has undergone the electrodeposition process is washed using washing water, the coated object is subjected to a pre-heating process during which the coated object is heated in a pre-drying furnace, and to a hot water spraying process subsequent to the pre-heating process, in which the steel plate mating portions of the coated object are sprayed with hot water or hot water mist.

This proposed method utilizes the fact that, if the temperature of the coating material-containing aqueous solution is increased, the surface tension and viscosity of the coating material-containing aqueous solution decrease, and consequently the coating material-containing aqueous solution is more likely to flow out of the steel plate mating portions.

That is, according to the proposed method, the temperature of a coating material-containing aqueous solution remaining in the steel plate mating portions rises during the pre-heating process in which the coated object is heated in a pre-drying furnace so that the surface tension and viscosity of the coating material-containing aqueous solution decrease.

Then, during the hot water spraying process that is subsequent to the pre-heating process, the steel plate mating portions are sprayed with hot water or hot water mist to keep the temperature of a coating material-containing aqueous solution remaining in the steel plate mating portions at a high temperature, to maintain a state in which the surface tension and viscosity of the coating material-containing aqueous solution are low.

Thus, a coating material-containing aqueous solution remaining in the steel plate mating portions is removed before the coated object is subjected to a drying process, by causing the coating material-containing aqueous solution to drip from the steel plate mating portions.

PRIOR ART DOCUMENTS

Patent Documents

Patent Document 1: JP 11-131291A

DISCLOSURE OF THE INVENTION

Problem to be Solved by the Invention

However, if the proposed method according to Patent Document 1 above is to be employed, it is necessary to newly prepare a pre-drying furnace that is dedicated to the pre-heating process, separately from the electrodeposition zone, the washing zone, and the drying zone in which the object to be coated is subjected to the electrodeposition process, the washing process, and the drying process, respectively.

Therefore, there is a problem in which the length of the electrodeposition line increases, the size of the system increases, and the initial costs of the system increase.

Also, when the coated objected that has undergone the washing process, which uses washing water, is subjected to the pre-heating process, which uses a pre-drying furnace, a portion of the heat supplied to the pre-drying furnace is consumed through the evaporation of washing water that remains on the surface of the coated object.

Therefore, there is a problem in which energy loss is large, which increases the running costs of the system.

Also, since energy loss in the pre-heating furnace is large, it takes a long time to increase the temperature of a coating material-containing aqueous solution remaining in the steel plate mating portions to a predetermined temperature.

Therefore, the length of the pre-drying furnace, in which the coated object is heated while being conveyed, increases, which is also a cause of an increase in the size of the system.

Furthermore, during the pre-heating process using the pre-drying furnace, if the heating temperature to which the coated object is heated in the pre-drying furnace is increased in order to increase the temperature of a coating material-containing aqueous solution remaining in the steel plate mating portions to a predetermined temperature in a short time, such an increased temperature accelerates the drying of a coating material component of the coating contained in the coating material-containing aqueous solution that has flowed out of the steel plate mating portions during the pre-heating process.

Thus, the final quality of the coating may be degraded in substantially the same manner as in the case where the coating material-containing aqueous solution flows out of the steel plate mating portions during the drying process, and consequently there is the risk of the reliability of the system being degraded contrary to expectations.

In view of such a situation, a main objective of the present invention is to prevent the final quality of a coating from being degraded due to a coating material-containing aqueous solution flowing out of steel plate mating portions (secondary sagging) during the drying process, while avoiding derivative problems as described above, by processing a coated object that has undergone an electrodeposition process, in a reasonable processing mode.

Means for Solving Problems

A first characteristic configuration of the present invention relates to an electrodeposition system, and the first characteristic configuration is characterized in that the electrodeposition system includes an electrodeposition zone in which an object to be coated is immersed in a coating material solution for electrodeposition so that a coating is formed on a surface of the object to be coated;

a washing zone in which the coated object having the coating formed on the surface thereof in the electrodeposition zone is washed using washing water; and a drying zone in which the coated object washed in the washing zone is heated so that the coating of the coated object is hardened and dried, and the washing zone is provided with at least:

a hot water washing tank in which the coated object is washed by being immersed in high-temperature washing water in the tank; and a spray washer that sprays a steel plate mating portion of the coated-object with high-temperature washing water, subsequent to washing in the hot water washing tank.

With this configuration, the temperature of the steel plate mating portion of the coated object is raised using high-temperature washing water in the hot water washing tank when the coated object is washed in the hot water washing tank by being immersed in high-temperature washing water, and thus the viscosity (kinematic viscosity) of a coating material-containing aqueous solution remaining in the steel plate mating portion is lowered.

Subsequent to the process in the hot water washing tank, the steel plate mating portion is sprayed with high-temperature washing water using the spray washer to keep the temperature of a coating material-containing aqueous solution remaining in the steel plate mating portion at a high temperature, to maintain a state in which the viscosity (kinematic viscosity) of the coating material-containing aqueous solution is low.

Consequently, it is easy to cause a coating material-containing aqueous solution remaining in the steel plate mating portion to flow out of the steel plate mating portion and remove it by using, for example, vibrations transmitted to the coated object when the coated object is conveyed or when the coated object is sprayed with high-temperature washing water.

Therefore, it is possible to effectively prevent the final quality of a coating from being degraded due to a coating material-containing aqueous solution flowing out of the steel plate mating portion during the drying process.

Also, with this configuration, the viscosity (kinematic viscosity) of a coating material-containing aqueous solution remaining in the steel plate mating portion is lowered as a result of the washing process during which the coated object is washed in the hot water washing tank. Therefore, a pre-drying furnace that is dedicated to a pre-heating process and is necessary for the method proposed in Patent Document 1, is unnecessary.

Consequently, it is possible to shorten the length of the electrodeposition line to reduce the size of the system, and to reduce the initial costs of the system.

Also, since the temperature of a coating material-containing aqueous solution remaining in the steel plate mating portion is raised by immersing the coated object in high-temperature washing water in the hot water washing tank, it is possible to prevent the heat applied to the high-temperature washing water from being partially consumed to evaporate washing water remaining on the surface of the coated object.

From this viewpoint, it is possible to reduce energy loss, and reduce the running costs of the system.

Also, since energy loss in the hot water washing tank is small, and the thermal conductivity between washing water and the steel plate mating portion is far higher than the thermal conductivity between air in the furnace and the steel plate mating portion, it is possible to reduce the time required to raise the temperature of a coating material-containing aqueous solution remaining in the steel plate mating portion to a required temperature in a short time.

That is, also from this point of view, it is possible to shorten the length of the electrodeposition line.

Furthermore, since the coated object is immersed in high-temperature washing water so that a coating material-containing aqueous solution remaining in the steel plate mating portion is heated, even if a coating material-containing aqueous solution remaining in the steel plate mating portion flows out during heating, the coating material-containing aqueous solution thus flowed out is only dispersed in the high-temperature washing water in the hot water washing tank, and the coating material component contained in the coating material-containing aqueous solution thus flowed out does not dry on the coating.

That is, from this point of view, it is also possible to secure a highly reliable system.

Therefore, with the above-described configuration, compared to the method proposed in Patent Document 1, it is possible to effectively prevent the final quality of the coating from being degraded due to the coating material-containing aqueous solution flowing out of the steel plate mating portion during the drying process, while avoiding derivative problems such as an increase in the size of the system, an increase in the initial costs and the running costs, and a decrease in reliability.

A second characteristic configuration of the present invention specifies an embodiment that is preferably employed when the first characteristic configuration is implemented. The second characteristic configuration is characterized in that the washing zone includes an upstream washing zone in which the coated object is washed using washing water that is clean water filtered through an ultrafiltration membrane, the hot water washing tank is configured such that pure water is used as the washing water, and the coated object washed in the upstream washing zone is washed by being immersed in high-temperature pure water in the tank, and the spray washer is configured to use pure water as the washing water, and spray the steel plate mating portion of the coated object with high-temperature pure water, subsequent to washing in the hot water washing tank.

With this configuration, in the upstream washing zone, clean water filtered through an ultrafiltration membrane is used as washing water, and in the subsequent hot water washing tank and spray washer, pure water that is more clean is used as washing water. Therefore, it is possible to enhance the effect of cleaning the surface of the coated object by performing washing, and to enhance the effect of cleaning the steel plate mating portion by washing away a coating material-containing aqueous solution remaining in the steel plate mating portion as much as possible.

Therefore, in synergy with the first characteristic configuration with which a coating material-containing aqueous solution remaining in the steel plate mating portion can be effectively removed, it is possible to more effectively improve the final quality of the coating.

A third characteristic configuration of the present invention specifies an embodiment that is preferably employed when the second characteristic configuration is implemented. The third characteristic configuration is characterized in that a dripping area in which the coated object is maintained in a state of being conveyed for a preset period of time so that washing water adhering to the coated object is allowed to drip from the coated object, is provided between the upstream washing zone and the hot water washing tank.

With this configuration, by setting a sufficient period of time as the preset period of time, it is possible to allow washing water adhering to the coated object to drip in the dripping area, and it is also possible to effectively promote a coating material-containing aqueous solution remaining in the steel plate mating portion to flow out, utilizing vibrations that are transmitted to the coated object when the coated object is conveyed.

Therefore, in synergy with the first characteristic configuration with which a coating material-containing aqueous solution remaining in the steel plate mating portion can be effectively removed, it is possible to more effectively prevent the final quality of the coating from being degraded due to the coating material-containing aqueous solution flowing out of the steel plate mating portion during the drying process.

A fourth characteristic configuration of the present invention specifies an embodiment that is preferably employed when the second characteristic configuration is implemented. The fourth characteristic configuration is characterized in that a water washing tank in which the coated object washed in the upstream washing zone using the pure water is washed by being immersed in room-temperature pure water in the tank is provided between the upstream washing zone and the hot water washing tank.

With this configuration, the water washing tank thus provided further improves the effect of cleaning the surface of the coated object by performing washing, and the effect of cleaning the steel plate mating portion by washing away a coating material-containing aqueous solution remaining in the steel plate mating portion as much as possible.

Therefore, in synergy with the first characteristic configuration with which a coating material-containing aqueous solution remaining in the steel plate mating portion can be effectively removed, it is possible to further improve the final quality of the coating.

A fifth characteristic configuration of the present invention specifies an embodiment that is preferably employed when the first or the second characteristic configuration is implemented. The fifth characteristic configuration is characterized in that the spray washer is provided with a plurality of spray ports that are arranged in a direction in which the coated object is conveyed, to spray the steel plate mating portion of the coated object with high-temperature washing water.

With this configuration, parts included in the steel plate mating portion of the coated object can be continuously sprayed with high-temperature washing water for a certain period of time while the coated object is conveyed.

Therefore, it is possible to more reliably keep the temperature of the steel plate mating portion to which it was raised in the hot water washing tank, and more reliably maintain a state in which the viscosity (kinematic viscosity) of a coating material-containing aqueous solution remaining in the steel plate mating portion is low.

Therefore, it is possible to more effectively prevent the final quality of a coating from being degraded due to a coating material-containing aqueous solution flowing out of the steel plate mating portion during the drying process.

A sixth characteristic configuration of the present invention specifies an embodiment that is preferably employed when the first or the second characteristic configuration is implemented. The sixth characteristic configuration is characterized in that the electrodeposition system further includes a vibration generation means that vibrates high-temperature washing water in the hot water washing tank.

With this configuration, in the state where the coated object is immersed in high-temperature washing water in the hot water washing tank, it is possible to effectively promote a coating material-containing aqueous solution remaining in the steel plate mating portion of the coated object to ooze and flow out to the high-temperature washing water in the tank by utilizing vibrations transmitted to the high-temperature washing water in the tank.

Therefore, in synergy with the first characteristic configuration with which a coating material-containing aqueous solution remaining in the steel plate mating portion can be effectively removed, it is possible to more effectively prevent the final quality of the coating from being degraded due to the coating material-containing aqueous solution flowing out of the steel plate mating portion during the drying process.

A seventh characteristic configuration of the present invention relates to an electrodeposition method, and the seventh characteristic configuration is characterized in that the electrodeposition method includes: an electrodeposition process during which an object to be coated is immersed in a coating material solution for electrodeposition so that a coating is formed on a surface of the object to be coated;

a washing process during which the coated object having the coating formed on the surface thereof during the electrodeposition process is washed using washing water; and a drying process during which the coated object washed during the washing process is heated so that the coating of the coated object is hardened and dried, and during the washing process, at least a hot water washing process during which the coated object is washed by being immersed in high-temperature washing water in a hot water washing tank; and a spray washing process during which a steel plate mating portion of the coated object is sprayed with high-temperature washing water using a spray washer, subsequent to the hot water washing process, are performed.

Therefore, with this method, compared to the method proposed in Patent Document 1, it is possible to effectively prevent the final quality of the coating from being degraded due to the coating material-containing aqueous solution flowing out of the steel plate mating portion during the drying process, while avoiding derivative problems such as an increase in the size of the system, an increase in the initial costs and the running costs, and a decrease in reliability, in the same mode as in the above-described first characteristic configuration.

BEST MODE FOR CARRYING OUT THE INVENTION

First Embodiment

The following describes a first embodiment of an electrodeposition system and an electrodeposition method according to the present invention with reference to the drawings.

Figure 1:
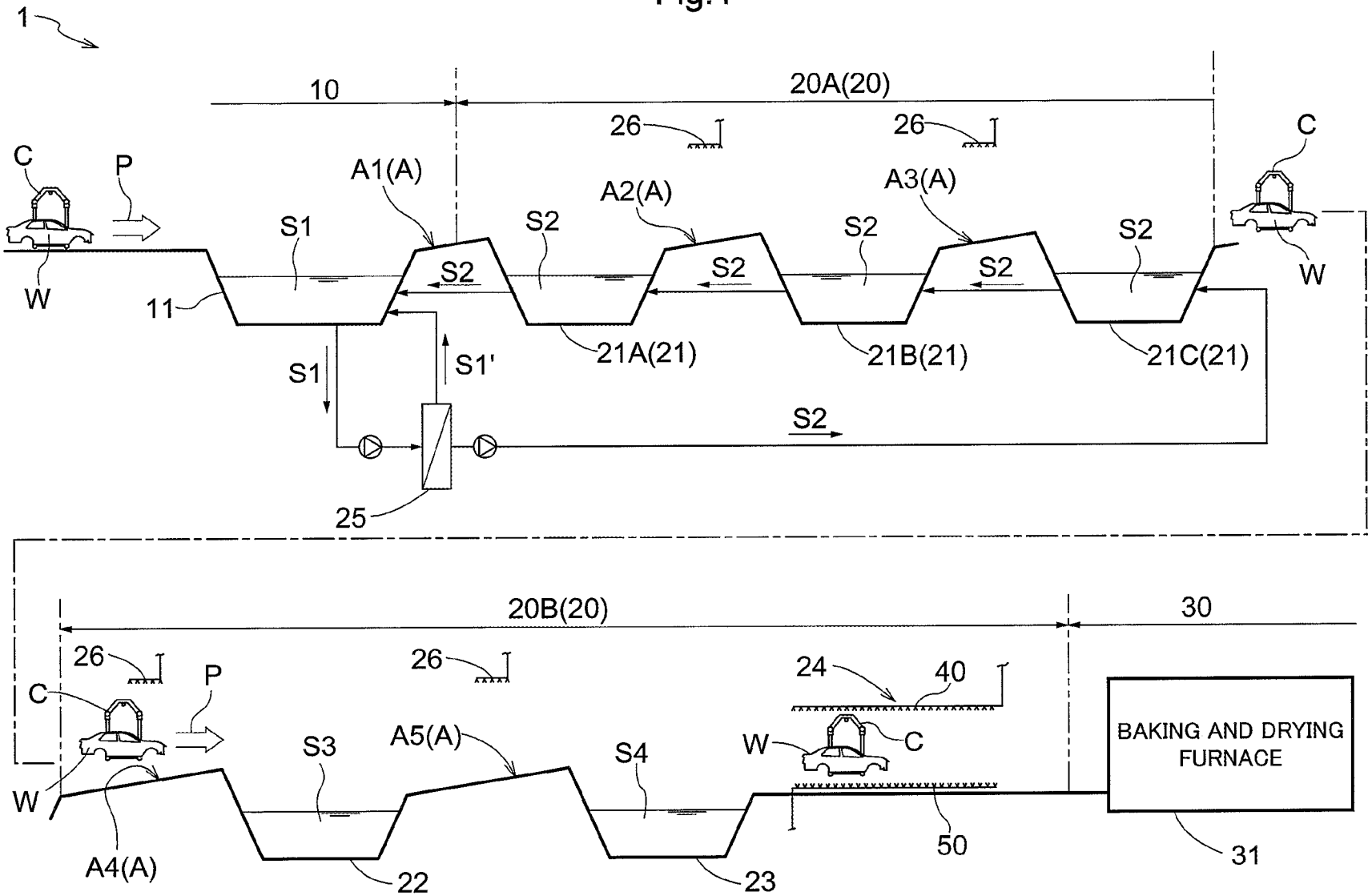
FIG. 1 shows an overall configuration of an electrodeposition system representing a first embodiment.

FIG. 1 shows an overall configuration of an electrodeposition system 1. The electrodeposition system 1 is provided with an electrodeposition zone 10, a washing zone 20, and a drying zone 30, which are zones in which coating-target objects W (the bodies of automobiles in the present embodiment) are processed.

The electrodeposition system 1 is also provided with a conveyance means C such as a conveyor, which sequentially conveys the coating-target objects W at predetermined conveyance intervals. The conveyance means C holds each of the coating-target objects W to be conveyed, using an appropriate jig such as a hanger receiving tool.

That is, in the electrodeposition system 1, the conveyance means C conveys the coating-target objects W to the electrodeposition zone 10, the washing zone 20, and the drying zone 30 in this order.

During conveyance, in the electrodeposition zone 10, coating-target objects W that pass through the zone undergo an electrodeposition process. In the washing zone 20, coating-target objects W that have undergone the electrodeposition process and pass through the zone undergo a washing process. In the drying zone, coating-target objects W that have undergone the washing process and pass through the zone undergo a drying process.

Note that since FIG. 1 shows an overall configuration, the dimensional ratio between the parts shown in FIG. 1 (e.g. the ratio between the length of tanks and the length of the coating-target objects W) is different from the actual dimensional ratio.

The electrodeposition zone 10 is provided with an electrodeposition tank 11. In the electrodeposition zone 10, a coating-target object W is subjected to the electrodeposition process, during which the coating-target object W is immersed in a coating material solution S1 for electrodeposition, which is stored in the electrodeposition tank 11. As a result of this immersion, a coating is formed on the surface of the coating-target object W due to electrical interactions between the coating material solution S1 and the coating-target object W.

The washing zone 20 is divided into first to fourth washing sections. The first washing section is provided with three washing tanks 21, the second washing section is provided with a water washing tank 22, the third washing section is provided with a hot water washing tank 23, and the fourth washing section, which is the last section, is provided with a spray washer 24.

In the first to fourth washing sections (21, 22, 23, and 24), a coating-target object W that has undergone the electrodeposition process is subjected to the washing process step by step.

The drying zone 30 is provided with a drying furnace 31. In the drying zone 30, a coating-target object W that has undergone the washing process is subjected to the drying process, during which the coating-target object W is placed in a high-temperature atmosphere at 100° C. or higher in the drying furnace 31, and the coating of the coating-target object W is hardened and dried due to the high-temperature atmosphere.

The washing zone 20 is roughly divided into an upstream washing zone 20A on the upstream side in a conveyance direction P of the coating-target object W, and a downstream washing zone 20B that is on the downstream side in the conveyance direction P of the coating-target objects W.

The first washing section (i.e. the three washing tanks 21) belongs to the upstream washing zone 20A, and the second washing section (i.e. the water washing tank 22), the third washing section (i.e. the hot water washing tank 23), and the fourth washing section (i.e. the spray washer 24) belong to the downstream washing zone 20B.

In the upstream washing zone 20A, clean water S2, which has been filtered by an ultrafiltration device 25 described below, is used as washing water for washing a coating-target object W that has undergone the electrodeposition process.

On the other hand, in the downstream washing zone 20B, pure water S3 and S4 is used as washing water for further washing the coating-target object W that has been washed in the upstream washing zone 20A (i.e. the washing tank 21).

That is, in the upstream washing zone 20A, a coating-target object W that has undergone the electrodeposition process is washed by being sequentially immersed in the clean water S2 stored in the three washing tanks 21 (21A to 21C).

In contrast, in the downstream washing zone 20B, a coating-target object W that has been washed in the upstream washing zone 20A using the clean water S2 is first washed by being immersed in the room-temperature pure water S3 stored in the water washing tank 22, which corresponds to the second washing section.

Subsequently, the coating-target object W that has been washed in the water washing tank 22 using the room-temperature pure water S3 is washed using high-temperature pure water S4 (i.e. pure water that has been heated to a predetermined temperature by an appropriate heating device) stored in the hot water washing tank 23, which corresponds to the third washing section.

The coating-target object W that has been washed in the hot water washing tank 23 using the high-temperature pure water S4 is further washed by the spray washer 24, which corresponds to the fourth washing section, spraying the coating-target object W with the pure water S4, which is also at a high temperature.

The ultrafiltration device 25 removes a coating material component from the coating material solution S1 for electrodeposition, which has been taken out of the electrodeposition tank 11 as a material solution, using an ultrafiltration membrane (a UF membrane), thereby generating the clean water S2 from which the coating material component has been removed, and also generates, as a by-product, a coating material solution S1' in a concentrated state, in which the density of the coating material component is high.

The clean water S2 generated by the ultrafiltration device 25 is supplied to the washing tank 21C that is the most downstream tank in the upstream washing zone 20A, whereas the coating material solution S1' in a concentrated state, which is a by-product generated by the ultrafiltration device 25, is returned to the electrodeposition tank 11.

The clean water S2 used in the most downstream washing tank 21C to wash a coating-target object W is sent to the next washing tank 21B on the upstream side, and is used again in the washing tank 21B to wash a coating-target object W.

The clean water S2 used in the washing tank 21B to wash a coating-target object W is further sent to the next washing tank 21A on the upstream side, and is used yet again in the washing tank 21A to wash a coating-target object W.

Then, the clean water S2 used yet again in the washing tank 21A to wash a coating-target object W is returned to the electrodeposition tank 11.

A significant amount of coating material solution S1 for electrodeposition in the electrodeposition tank 11 is taken out of the electrodeposition tank 11 together with a coating-target object W that has undergone the electrodeposition process, in the state of adhering to the coating-target object W.

However, the coating material solution S1 thus taken out is washed off from a coating-target object W when the coating-target object W is washed in the washing tanks 21A to 21C using the clean water S2, and is then returned from the washing tanks 21A to 21C to the electrodeposition tank 11 together with the clean water S2 thus used.

Therefore, despite the coating material solution S1 being taken out of the electrodeposition tank 11 together with a coating-target object W, and despite clean water S2 being taken out of the electrodeposition tank 11 by the ultrafiltration device 25, the amount and density of coating material solution S1 stored in the electrodeposition tank 11 are stably maintained.

During the electrodeposition process for the coating-target object W and the subsequent washing process, the coating material solution and washing water used in these processes enters into steel plate mating portions Wa of the coating-target object W.

The steel plate mating portions Wa are bag-shaped portions that are present in the body of an automobile, such as those at the doors and the back side of the bonnet, and are gaps between steel plates where the entrances thereof are narrowed due to steel plates being brought into contact with each other when the object to be coated is processed, so that communication with the outside is limited.

The coating solution S1 and washing water S2 that have entered into the steel plate mating portions Wa are likely to remain in the steel plate mating portions Wa in the form of a coating material-containing aqueous solution in which the coating solution S1 and washing water S2 are mixed with each other, even after the washing process is completed.

Therefore, during the drying process in which the coating-target object W is placed in a high-temperature atmosphere in the drying furnace 31, a coating material-containing aqueous solution remaining in the steel plate mating portions Wa rapidly boils due to rapid heating, and flows out of the steel plate mating portions Wa, and a coating material-containing aqueous solution that has flowed out adheres to a neighboring portion of the coating of the coated object (the occurrence of so-called "secondary sagging").

Then, a coating material component contained in the coating material-containing aqueous solution adhering to the coating is hardened and dried in the drying furnace 31 together with the coating, in the state of adhering to the coating.

Conventionally, there is a problem in which the final quality of the coatings of coated objects W is significantly degraded due to the above-described phenomenon (degradation in the final quality of coatings due to secondary sagging).

To address this problem, in the electrodeposition system 1 according to the first embodiment, the downstream washing zone 20B, in which a coating-target object W that has undergone the electrodeposition process is ultimately washed using pure water, is provided with the water washing tank 22, which corresponds to the second washing section in which the coating-target object W is immersed in the room-temperature pure water S3, and the hot water washing tank 23, which corresponds to the third washing section in which the coating-target object W is subsequently immersed in the high-temperature pure water S4.

That is, since the water washing tank 22 and the hot water washing tank 23 using pure water are provided, it is possible to more effectively wash away a coating material-containing aqueous solution remaining in the steel plate mating portions Wa using pure water, compared to a system that is provided with only one washing section in which a coating-target object W is washed by being immersed in pure water. Consequently, it is possible to mitigate the above-described problem, i.e. degradation in the final quality of coatings due to the coating material-containing aqueous solution flowing out of the steel plate mating portions Wa during the drying process.

Also, in order to more reliably avoid the above-described problem, in the electrodeposition system 1 according to the first embodiment, the downstream washing zone 20B is provided with the hot water washing tank 23, which corresponds to the third washing section in which a coating-target object W is washed by being immersed in the high-temperature pure water S4, and the spray washer 24, which corresponds to the fourth washing section in which the coating-target object W is washed by being sprayed with the high-temperature pure water S4.

Figure 2:
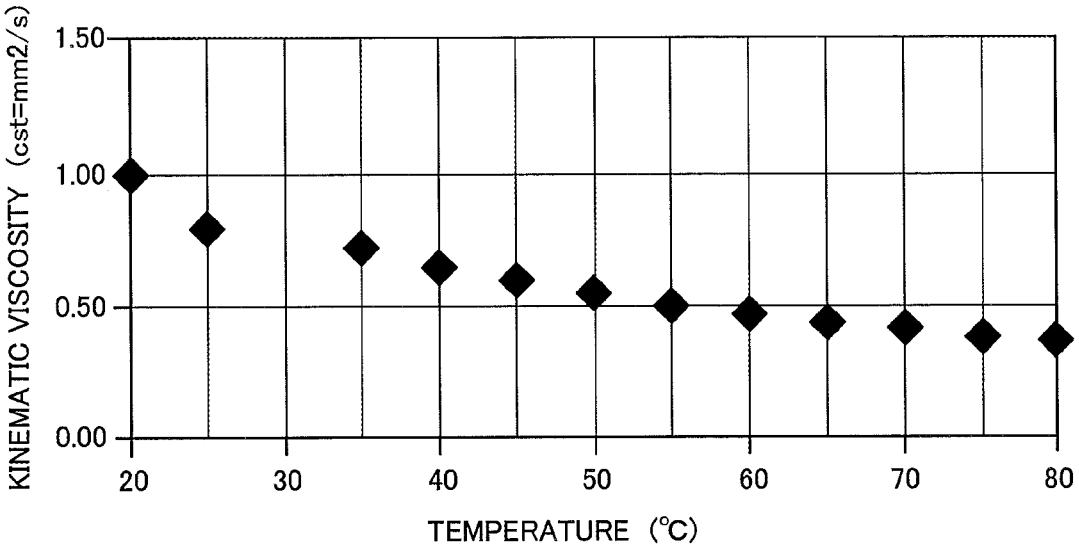
FIG. 2 shows a correlation between a surface temperature of a coated object and a kinematic viscosity of a coating material-containing aqueous solution.

Specifically, as can be seen from FIG. 2, which shows a correlation between the surface temperature of a coating-target object W and the viscosity (kinematic viscosity) of the coating material-containing aqueous solution, the viscosity (kinematic viscosity) of the coating material-containing aqueous solution decreases as the temperature increases.

Considering this fact, in the electrodeposition system 1 according to the first embodiment, a coating-target object W is immersed in the high-temperature pure water S4 in the hot water washing tank 23. Therefore, it is possible to efficiently increase the temperature of a coating material-containing aqueous solution remaining in the steel plate mating portions Wa in a short time while the coating-target object W is washed in the hot water washing tank 23.

That is, since the thermal conductivity between water and a coating-target object W is far higher than the thermal conductivity between air and a coating-target object W, it is possible to efficiently increase the temperature of a coating material-containing aqueous solution remaining in the steel plate mating portions Wa in a short time by bringing the coating-target object W into contact with the high-temperature pure water S4 in the hot water washing tank 23.

Consequently, it is possible to effectively lower the viscosity (kinematic viscosity) of a coating material-containing aqueous solution remaining in the steel plate mating portions Wa in a short time in the hot water washing tank 23.

Subsequently, the spray washer 24 washes the coating-target object W by spraying the coating-target object W with high-temperature pure water S4. Therefore, using the high-temperature pure water S4, it is possible to effectively keep the temperature of a coating material-containing aqueous solution remaining in the steel plate mating portions Wa at or near the temperature to which it was raised in the hot water washing tank 23 in the preceding stage.

Consequently, it is possible to effectively maintain a state in which the viscosity (kinematic viscosity) of a coating material-containing aqueous solution remaining in the steel plate mating portions Wa is low.

Therefore, in the spray washer 24, it is easy to cause a coating material-containing aqueous solution remaining in the steel plate mating portions Wa to flow out of the steel plate mating portions Wa and remove it by using minor vibrations transmitted to the coating-target object W when the coating of coated object W is sprayed with high-temperature pure water S4, or when the coating-target object W is conveyed. Consequently, it is possible to more reliably prevent the final quality of the coating of coated object W from being degraded due to the coating material-containing aqueous solution flowing out of the steel plate mating portions Wa during the drying process.

Figure 3:
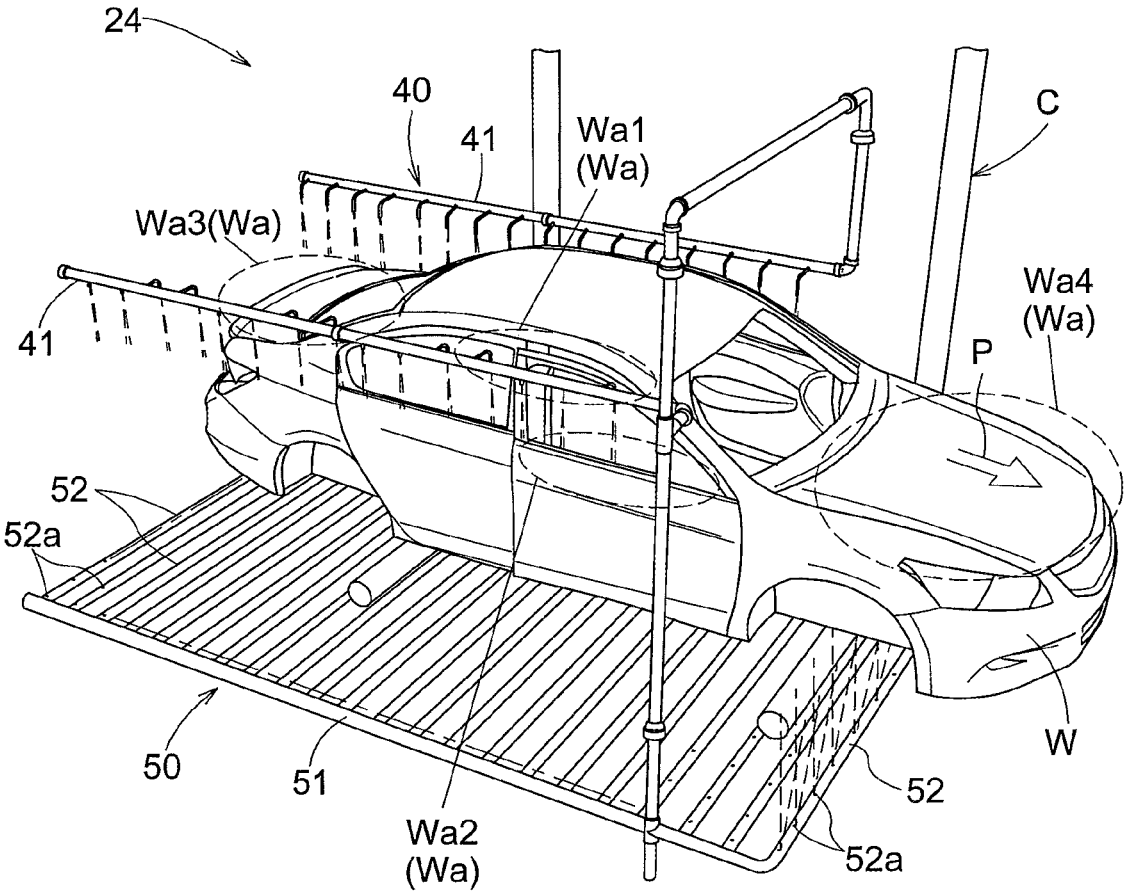
FIG. 3 is a perspective view of a spray washing section.
Figure 4:
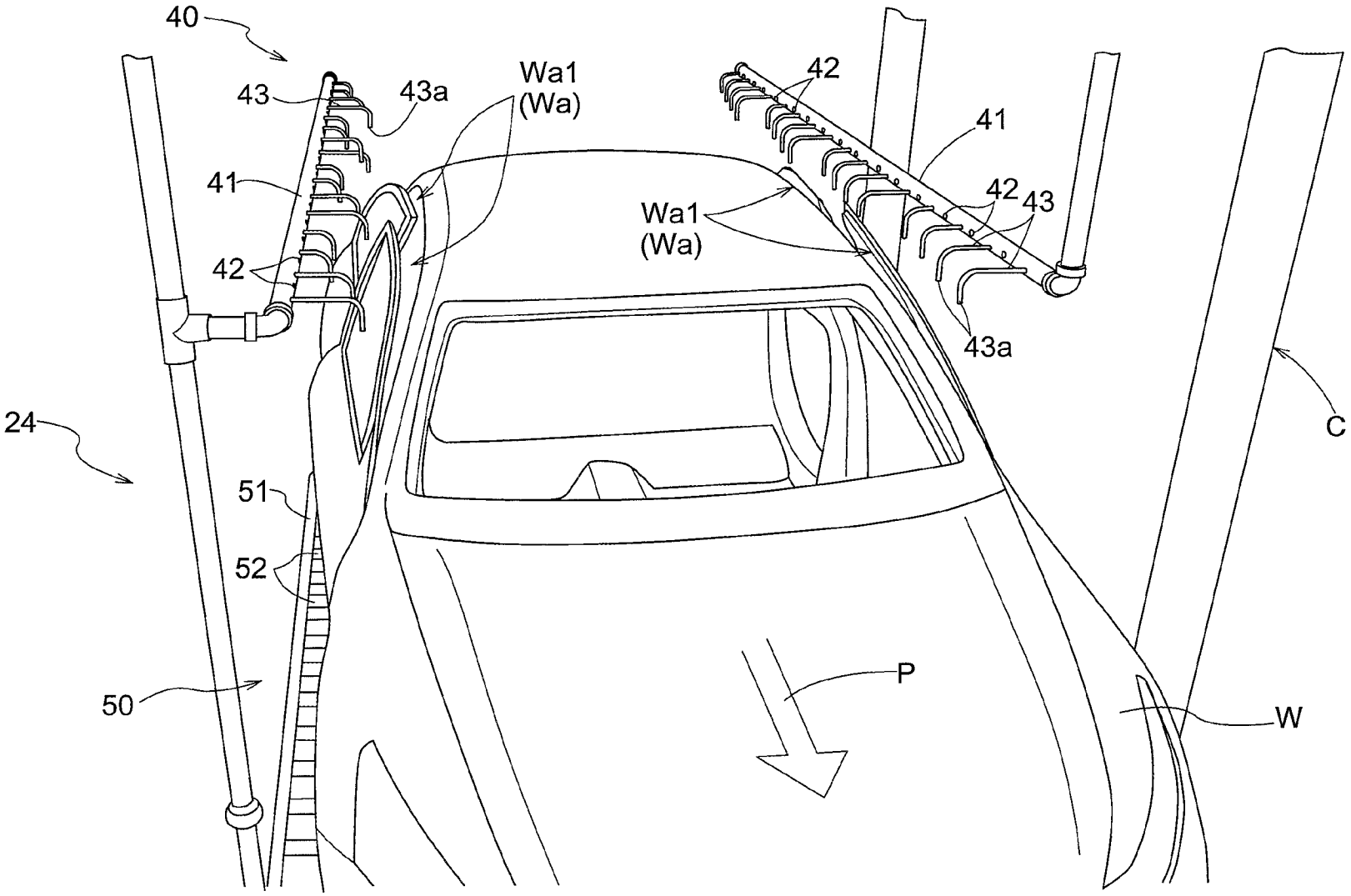
FIG. 4 is an enlarged perspective view of a main portion of the spray washing section.

As shown in FIGS. 3 to 4, the spray washer 24, which corresponds to the fourth washing section in which a coating-target object W is sprayed with high-temperature pure water S4, includes an upper spraying unit 40 that is located above the conveyed coating-target object W, and a lower spraying unit 50 that is located below the conveyed coating-target object W.

The upper spraying unit 40 includes a pair of left and right header tubes 41 that are supplied with high-temperature pure water S4 from a supply source, to be filled with high-temperature pure water S4. The pair of header tubes 41 are orientated so as to extend in the conveyance direction P of the coating-target object W, and are located in the vicinity of both side surfaces of the conveyed coating-target object W in plan view.

Each of the header tubes 41 is provided with a large number of spray ports 42, which are for spraying the conveyed coating-target object W with high-temperature pure water S4, and a large number of curving spray tubes 43, which are also for spraying the conveyed coating-target object W with high-temperature pure water S4. The spray ports 42 and the curving spray tubes 43 are arranged in the lengthwise direction of the header tubes 41.

The spray ports 42 and the curving spray tubes 43 are arranged one after the other in the lengthwise direction of the header tubes 41.

The spray ports 42 are arranged such that sash portions Wa1 at the upper edges of the openings of the doors, which are examples of the steel plate mating portions Wa of the coating-target object W, are sprayed with high-temperature pure water S4 ejected from the spray ports 42.

In contrast, spray ports 43*a* of the curving spray tubes 43 are arranged such that bag-shaped portions Wa2 at the door in the body of the automobile, which are examples of the steel plate mating portions Wa of the coating-target object W, are sprayed with high-temperature pure water S4 ejected from the spray ports 43*a*.

That is, in the spray washer 24, which corresponds to the fourth washing section, the aforementioned sash portions Wa1 and the aforementioned door bag-shaped portions Wa2 of the coating-target object W are intensively sprayed with high-temperature pure water S4 from a large number of spray ports 42 and the spray ports 43*a* of the large number of curving spray tubes 43 included in the upper spraying unit 40 while the coating-target object W is conveyed.

Also, since the large number of spray ports 42 and the large number of curving spray tubes 43 are arranged in the lengthwise direction of the header tubes 41 (i.e. the conveyance direction P of the coating-target object W), parts included in the sash portions Wa1 and the bag-shaped portions Wa2 are continuously sprayed with high-temperature pure water S4 for a certain period of time.

Consequently, the temperature of the sash portions Wa1 and the door bag-shaped portions Wa2, which are examples of the steel plate mating portions Wa, is effectively kept at or near the temperature to which it was raised in the hot water washing tank 23 in the preceding stage.

Then, the coating material-containing aqueous solution that has flowed out of the sash portions Wa1 and the door bag-shaped portions Wa2 is washed off from the coating-target object W with high-temperature pure water S4 thus sprayed.

Note that high-temperature pure water W is ejected downward from the spray ports 43*a* of the curving spray tubes 43, and therefore even parts that are elongated in the vertical direction, of the door bag-shaped portions Wa2, can be appropriately sprayed with high-temperature pure water W.

Also, the curving spray tubes 43 of the header tubes 41 are divided into groups each composed of four successive curving spray tubes 43, and the dimensions of the protrusions toward the coating-target object W of the four curving spray tubes 43 in each group are slightly varied in size stepwise.

With this configuration, even if the door bag-shaped portions Wa2 are inclined toward the left or right to some extent relative to the conveyance direction P of the coating-target object W, the entire widths of the door bag-shaped portions Wa2 in the conveyance direction P of the coating-target object W can be appropriately and effectively sprayed with high-temperature pure water S4 while the coating-target object W is conveyed.

The lower spraying unit 50 includes, as shown in FIG. 3, a pair of left and right main header tubes 51 that are supplied with high-temperature pure water S4 from a supply source, to be filled with high-temperature pure water S4. The pair of main header tubes 51 are orientated so as to extend in the conveyance direction P of the coating-target object W, and are located in the vicinity of both side surfaces of the conveyed coating-target object W in plan view.

Also, a large number of branch header tubes 52 that span between the left and right main header tubes 51 are provided continuously with the main header tubes 51, in the state of being arranged in the lengthwise direction of the main header tubes 51.

Each of the branch header tubes 51 is provided with a large number of spray ports 52*a*, which are for spraying the conveyed coating-target object W with high-temperature pure water S4 upward. The spray ports 52*a* are arranged in the lengthwise direction of the branch header tubes 51.

That is, in the spray washer 24, which corresponds to the fourth washing section, a trunk back-side portion Wa3 and a bonnet back-side portion Wa4 (strictly speaking, a trunk back-side portion and a bonnet back-side portion in which a large number of steel plate mating portions Wa are present) in the body of the automobile, which are examples of the steel plate mating portions Wa of the coating-target object W, are sprayed with high-temperature pure water S4 from a large number of spray ports 52*a* included in the lower spraying unit 50 while the coating-target object W is conveyed.

Since a large number of branch header tubes 52 are arranged in the conveyance direction P of the coating-target object W, parts included in the trunk back-side portion Wa3 and the bonnet back-side portion Wa4 are continuously sprayed with high-temperature pure water S4 for a certain period of time.

Consequently, the temperature of the trunk back-side portion Wa3 and the bonnet back-side portion Wa4, which are examples of the steel plate mating portions Wa, is effectively kept at or near the temperature to which it was raised in the hot water washing tank 23 in the preceding stage.

Then, the coating material-containing aqueous solution that has flowed out of the trunk back-side portion Wa3 and the bonnet back-side portion Wa4 is washed off from the coating-target object W with high-temperature pure water S4 thus sprayed.

In this way, since the spray washer 24, which corresponds to the fourth washing section, is provided with the upper spraying unit 40 and the lower spraying unit 50, the steel plate mating portions Wa at several positions in the coating-target object W (the sash portions Wa1, the door bag-shaped portions Wa1, the trunk back-side portion Wa3, and the bonnet back-side portion Wa4 in the body of the automobile) are effectively sprayed with high-temperature pure water S4.

As a result of spraying high-temperature pure water S4 from the upper spraying unit 40 and the lower spraying unit 50, the temperature of a coating material-containing aqueous solution remaining in each of the steel plate mating portions Wa (Wa1 to Wa4) is kept at a high temperature, and the viscosity (kinematic viscosity) of the coating material-containing aqueous solution is maintained at a low viscosity. Therefore, it is easy to cause a coating material-containing aqueous solution remaining in the steel plate mating portions Wa to reliably flow out of the steel plate mating portions Wa by using minor vibrations transmitted to the coating-target object W when the coated object W is sprayed with the high-temperature pure water S4, or when the coating-target object W is conveyed.

Note that vibrations transmitted to the coating-target object W are not limited to those caused by the spraying of high-temperature pure water S4 or the conveyance of the coating-target object W, and it is possible to provide the conveyance means C with a vibration generator or an impact generator to positively supply vibrations and impact to the coating-target object W.

The temperature of high-temperature pure water S4 used as washing water in the hot water washing tank 23 and the spray washer 24, which serve as the third and fourth washing sections, may be set to any temperature as appropriate, but is preferably 50° C. or higher.

A certain degree of effect can be produced even if the temperature of high-temperature pure water S4 used as washing water is in the range of 30° C. to 40° C. However, if the temperature of high-temperature pure water S4 used as washing water is 50° C. or higher, it is possible to more easily and more reliably cause a coating material-containing aqueous solution remaining in the steel plate mating surface portions Wa to flow out of the steel plate mating surface portions Wa.

As shown in FIG. 2, if the temperature is higher than 50° C., the rate of decrease of the viscosity (kinematic viscosity) of the coating material-containing aqueous solution in response to a rise in the temperature decreases. Therefore, it is particularly preferable that the temperature of high-temperature pure water S4 used as washing water is 50° C., from the viewpoint of saving the energy required to heat pure water S4, as much as possible.

The time required for a coating-target object W to pass through the spray washer 24, which corresponds to the fourth washing section, is preferably one minute or longer.

Dripping areas A (A1 to A5) are provided between the tanks 11, 21A to 21C, 22, and 23, which serve as the first to third washing sections. In each of the dripping areas A, drops of solution, which have been taken out from the tank on the upstream side together with a coating-target object W in the state of adhering to the coating, are allowed to drip.

Drops of solution that have dripped from a coating-target object W in each of the dripping areas A (A1 to A5) flow along an inclined floor of the dripping area A to return to the tank adjacent thereto on the upstream side (i.e. the tank from which a solution was taken out).

The dripping areas A2 to A5 in the washing zone 20 are respectively provided with shower devices 26 for washing a coating-target object W that passes therethrough.

These shower devices 26 sprinkle a coating-target object W with washing water that is the same as the washing water (the clean water S2, the room-temperature water S3, and the high-temperature pure water S4) used in the tanks that are closest thereto, such as the tank adjacent thereto on the downstream side and the tank adjacent thereto on the upstream side.

The dripping area A4 between the washing tank 21C, which corresponds to the first washing section, and the water washing tank 22, which corresponds to the second washing section, and the dripping area A5 between the water washing tank 22, which corresponds to the second washing section, and the hot water washing tank 23, which corresponds to the third washing section, are longer than the other dripping areas A1, A2, and A3 in the conveyance direction P of the coating-target objects W.

That is, the time required for a coating-target object W to pass through each of the two dripping areas A4 and A5 is set to be longer than that of the other dripping areas A1, A2, and A3, so that, in the two dripping areas A4 and A5, not only the solution simply adhering to the surface of a coating-target object W, but also a coating material-containing aqueous solution remaining in the steel plate mating portions Wa can be caused to flow out due to vibrations generated when the coating-target object W is conveyed.

In summary, in the electrodeposition system 1 according to the first embodiment, a coating-target object W is first subjected to the electrodeposition process, during which the coating-target object W is immersed in the coating material solution S1 for electrodeposition stored in the electrodeposition tank 11, and thus a coating is formed on the coating-target object W.

Subsequently, the coating-target object W is subjected to a washing process using filtered clean water, during which the coating-target object W is washed by being sequentially immersed in the clean water S2 stored in the three washing tanks 21 (21A to 21C), which serve as the first washing section.

Then, a washing process using pure water is subsequently performed.

In the washing process using pure water, first, a water washing process using pure water is performed, during which the coating-target object W is washed by being immersed in the room-temperature pure water S3 stored in the water washing tank 22, which corresponds to the second washing section.

Subsequently, a hot water washing process using pure water is performed, during which the coating-target object W is washed by being immersed in the high-temperature pure water S4 stored in the hot water washing tank 23, which corresponds to the third washing section.

The coating-target object W is immersed in the high-temperature pure water S4 during the hot water washing process, and therefore the temperature of a coating material-containing aqueous solution remaining in the steel plate mating portions Wa of the coating-target object W is raised in a short time, and thus the viscosity (kinematic viscosity) of a coating material-containing aqueous solution remaining in the steel plate mating portions Wa is lowered.

Subsequently, a spray washing process using pure water is performed, during which the coating-target object W is washed by being sprayed with the high-temperature pure water S4 in the spray washer 24.

The coating-target object W is washed by being sprayed with the high-temperature pure water S during the spraying washing process, and therefore the temperature of a coating material-containing aqueous solution remaining in the steel plate mating portions Wa of the coating-target object W is kept at a high temperature, and the viscosity (kinematic viscosity) of a coating material-containing aqueous solution remaining in the steel plate mating portions Wa is maintained at a low viscosity.

Consequently, it is easy to cause a coating material-containing aqueous solution remaining in the steel plate mating portions Wa to reliably flow out of the steel plate mating portions Wa and remove it by using vibrations transmitted to the coating-target object W when the coating-target object W is sprayed with high-temperature pure water, or when the coating-target object W is conveyed.

That is, a coating material-containing aqueous solution remaining in the steel plate mating portions Wa is thus removed from the steel plate mating portions Wa to prevent the final quality of the coating from being degraded due to the coating material-containing aqueous solution flowing out of the steel plate mating portions Wa during the subsequent drying process.

Also, with this configuration, the washing process for washing the coating-target object W in the hot water washing tank 23 is used to raise the temperature of a coating material-containing aqueous solution remaining in the steel plate mating portions Wa, and therefore it is possible to prevent the length of the electrodeposition line from being long.

Also, if coating material-containing washing water remaining in the steel plate mating portions Wa is heated using the high-temperature pure water S4 in the hot water washing tank 23, it is possible to avoid an energy loss problem such as a problem in which some of the heat applied to the high-temperature pure water S4 is consumed to evaporate drops of washing water which have been taken to the hot water washing tank 23 and adhere to the coating-target object W.

Furthermore, even if the coating material-containing aqueous solution flows out of the steel plate mating portions Wa due to being heated in the hot water washing tank 23 using the high-temperature pure water S4, the coating material-containing aqueous solution thus flowed out is only dispersed in the high-temperature pure water S4 stored in the hot water washing tank 23, and the coating material component contained in the coating material-containing aqueous solution thus flowed out does not dry on the coating.

That is, with the electrodeposition system 1 according to the first embodiment, it is possible to effectively prevent the final quality of a coating from being degraded due to a coating material-containing aqueous solution flowing out of the steel plate mating portions Wa during the drying process, while avoiding derivative problems such as an increase in the size of the system, an increase in the initial costs and the running costs, and a decrease in reliability.

Second Embodiment

Next, the following describes a second embodiment of an electrodeposition system and an electrodeposition method according to the present invention with reference to the drawings.

Note that differences from the electrodeposition system in the first embodiment will be mainly described below. Therefore, features that are not specifically described are the same as those of the first embodiment.

Also, the same components as those in the electrodeposition system in the first embodiment are assigned the same reference numerals as in the first embodiment.

Figure 5:
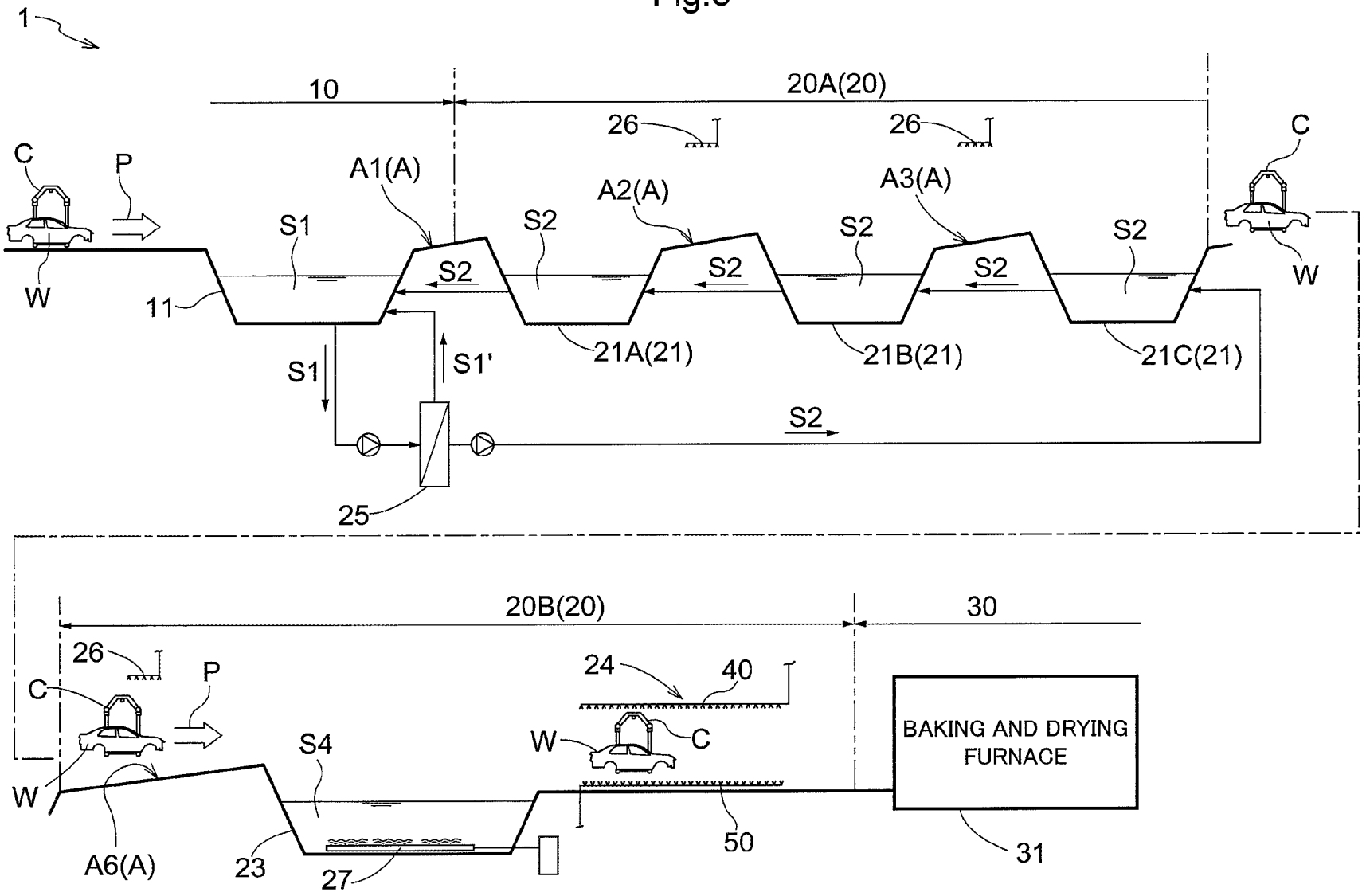
FIG. 5 shows an overall configuration of an electrodeposition system representing a second embodiment.

FIG. 5 shows an electrodeposition system 1 according to the second embodiment. From this electrodeposition system 1, the water washing tank 22 (i.e. the water washing tank used to wash a coating-target object W by immersing the coating-target object W in the room-temperature pure water S3 stored in the tank) of the electrodeposition system in the first embodiment is omitted.

That is, the downstream washing zone 20B is only provided with the hot water washing tank 23 that is used to wash a coating-target object W by immersing the coating-target object W in the high-temperature pure water S4, and the spray washer 24 used to wash the coating-target object W by spraying the coating-target object W with the high-temperature pure water S4.

The hot water washing tank 23 is equipped with an air agitation device 27 (an example of the vibration generation means) that vibrates the high-temperature pure water S4 in the tank. The air agitation device 27 provides vibration to the high-temperature pure water S4 in the hot water washing tank 23 by blowing compressed air into the high-temperature pure water S4 in the hot water washing tank 23.

That is, the air agitation device 27 vibrates the high-temperature pure water W4 to improve the effect of washing a coating-target object W in the hot water washing tank 23.

Also, a dripping area A6 provided between the washing tank 21C and the hot water washing tank 23 is configured such that a coating-target object W takes 1.5 minutes or longer to pass therethrough.

That is, by securing time required to pass through the dripping area A6, a coating material-containing aqueous solution is promoted to flow out of the steel plate mating portions Wa while a coating-target object W passes through the dripping area A6.

Other Embodiments

Next, the following describes other embodiments of an electrodeposition system and an electrodeposition method according to the present invention.

Note that the configurations described in the first embodiment and the second embodiment, and the configurations disclosed in the other embodiments below may be combined with each other as long as there is no contradiction.

(1) The first and second embodiments above show examples in which the spray ports 42, 43*a*, and 52*a* provided in the spray washer 24 are fixed relative to the ground.

However, the present invention is not limited to such a configuration, and the positions and the orientations of the spray ports 42, 43*a*, and 52*a* may be changed so as to follow the movement of a coating-target object W.

Also, the whole spray washer 24 may be configured to move so as to follow the movement of a coating-target object W.

In both cases, the specific configuration of the spray washer 24 may be variously modified.

(2) The second embodiment above shows an example in which the hot water washing tank 23 is equipped with the air agitation device 27 that vibrates the high-temperature pure water S4 in the hot water washing tank 23 as an example of the vibration generation means However, the present invention is not limited to such a configuration, and various kinds of vibration generators may be employed as the vibration generation means for vibrating the high-temperature pure water S4 in the hot water washing tank 23.

Also, the hot water washing tank 23 in the first embodiment above may be equipped with the vibration generation means (3) The embodiments above show examples provided with the upstream washing zone 20A, in which a coating-target object W is washed using filtered clean waters S2, and the downstream washing zone 20B, in which a coating-target object W is washed using pure water S3 and S4.

However, the present invention is not limited to such a configuration. To carry out the present invention, the present invention only needs to be provided with at least the hot water washing tank 23 that is used to wash a coating-target object W by immersing the coating-target object W in high-temperature washing water, and the spray washer 24 that is used to wash the coating-target object W by spraying the coating-target object W with high-temperature washing water, subsequent to washing in the hot water washing tank 23, and the overall configuration of equipment may be variously modified from such a viewpoint.

(4) The embodiments above show examples in which a coating-target object W is continuously conveyed through the dripping area A without being stopped. However, the present invention is not limited to such a configuration, and a coating-target object W may be stopped for a predetermined period of time in the dripping area A.

For example, a coating-target object W may be stopped for 1.5 minutes or longer in the dripping area A4 or dripping area A5 shown in the first embodiment, or the dripping area A6 shown in the second embodiment.

(5) Other configurations shown in the embodiments are also only examples, and the present invention is not limited to the configurations shown in the examples, and various embodiments may be employed to carry out the present invention.

INDUSTRIAL APPLICABILITY

The present invention is applicable to electrodeposition for not only the body of an automobile, but also various kinds of coating-target objects.

DESCRIPTION OF REFERENCE SIGNS

W: Coating-target Object
S1: Coating Material Solution for Electrodeposition
10: Electrodeposition Zone
20: Washing Zone
30: Drying Zone
S4: Pure Water (Washing Water)
23: Hot Water Washing Tank
Wa: Steel Plate Mating Portion
24: Spray Washer
S2: Clean Water (Washing Water)
20A: Upstream Washing Zone
A4, A5, A6: Dripping Area
S3: Pure Water
22: Water Washing Tank
42, 43*a*: Spray Port
P: Conveyance Direction
27: Air Agitation Device (Vibration Generation Means)

The invention claimed is:

1. An electrodeposition system comprising:

an electrodeposition zone in which an object to be coated is immersed in a coating material solution for electrodeposition so that a coating is formed on a surface of the object to be coated;

a washing zone in which the coated object having the coating formed on the surface thereof in the electrodeposition zone is washed using washing water; and a drying zone in which the coated object washed in the washing zone is heated so that the coating of the coated object is hardened and dried, wherein the washing zone is provided with at least:

a hot water washing tank in which the coated object is washed by being immersed in high-temperature washing water in the hot water washing tank; and a spray washer that sprays first and second kinds of steel plate mating portions of the coated object with high-temperature washing water, subsequent to washing in the hot water washing tank, wherein the spray washer is provided with spray ports and curving spray tubes to spray a corresponding kind of the steel plate mating portion of the coated object with the high-temperature washing water, and wherein the spray ports are for spraying, with high-temperature washing water, a first kind of steel plate mating portion which is parallel to the direction in which the coated object is conveyed, arranged to include two adjacent spray ports, including an upstream-side spray port positioned upstream and a downstream-side spray port positioned downstream in the direction in which the coated object is conveyed being arranged at an interval that continuously sprays the first kind of steel plate mating portion with the high-temperature washing water from the upstream-side spray port and sprays the first kind of steel plate mating portion with the high-temperature washing water from the downstream-side spray port as the coated object is conveyed, wherein the curved spray tubes comprise nozzles for spraying a second kind of steel plate mating portion which is angled relative to the direction in which the coated object is conveyed with high-temperature washing water, the curved spray tubes are arranged in the direction in which the coated object is conveyed and the nozzles are arranged parallel to the second kind of steel plate mating portion, and the spray washer is provided with a plurality of curved spray tube sets which are arranged in the direction in which the coated object is conveyed, the sets comprise a plurality of the nozzles which are parallel to the second kind of steel plate mating portion.

2. The electrodeposition system according to claim 1, wherein the washing zone includes an upstream washing zone in which the coated object is washed using washing water that is clean water filtered through an ultrafiltration membrane, the hot water washing tank is configured such that pure water is used as the high-temperature washing water, and the coated object washed in the upstream washing zone is washed by being immersed in high-temperature pure water in the hot water washing tank, and the spray washer is configured to use pure water as the high-temperature washing water, and spray the steel plate mating portion of the coated object with high-temperature pure water, subsequent to washing in the hot water washing tank.

3. The electrodeposition system according to claim 2, wherein a dripping area in which the coated object is maintained in a state of being conveyed for a preset period of time so that the washing water adhering to the coated object is allowed to drip from the coated object, is provided between the upstream washing zone and the hot water washing tank.

4. The electrodeposition system according to claim 2, wherein a water washing tank in which the coated object washed in the upstream washing zone using the pure water is washed by being immersed in room-temperature pure water in the water washing tank is provided between the upstream washing zone and the hot water washing tank.

5. The electrodeposition system according to claim 1, further comprising:

a vibrator configured to vibrate the high-temperature washing water in the hot water washing tank.

* * * * *